United States Patent [19]

Dreyer

[11] 4,358,174

[45] Nov. 9, 1982

[54] INTERCONNECTED ASSEMBLY OF AN ARRAY OF HIGH FREQUENCY COAXIAL CONNECTORS

[75] Inventor: Charles W. Dreyer, Fairfield, Conn.

[73] Assignee: Sealectro Corporation, Mamaroneck, N.Y.

[21] Appl. No.: 135,004

[22] Filed: Mar. 31, 1980

[51] Int. Cl.[3] ..... H01R 17/18; H01R 21/28

[52] U.S. Cl. ..... 339/64 M; 339/177 R

[58] Field of Search ..... 339/64 R, 64 M, 177 R, 339/177 E

[56] References Cited

U.S. PATENT DOCUMENTS

| | | | |
|---|---|---|---|
| 3,094,364 | 6/1963 | Lingg | 339/64 M |
| 3,184,706 | 5/1965 | Atkins | 339/177 R |
| 3,525,973 | 8/1970 | Kipnes | 339/177 R |
| 3,566,334 | 2/1971 | Ziegler et al. | 339/64 M |
| 4,099,825 | 7/1978 | Jackson | 339/177 E |
| 4,231,629 | 11/1980 | Kirby | 339/177 E X |
| 4,333,697 | 6/1982 | Dreyer | 339/31 R |

*Primary Examiner*—Eugene F. Desmond

*Attorney, Agent, or Firm*—Hedman, Casella, Gibson & Costigan

[57] ABSTRACT

An interconnected assembly of an array of high frequency coaxial connectors includes a pair of mounting plates having opposed mating coaxial electrical connectors mounted therein. The opposed connectors are configured such that a redundant or dual electrical connection is established when one connector is telescopingly received within the other connector. The redundant connection includes a butted interface, as well as a frictional interfit between the connectors. This arrangement eliminates the need to provide individual coupling nuts for securing the link between mated pairs of connectors which enables the distance between connectors along each plate to be reduced thereby conserving space. Further, due to the redundant electrical connection, should vibration or misalignment cause the mated connectors to separate, thereby breaking the butt interface connection, electrical continuity is still maintained. In a preferred embodiment of the subject invention, one of the connectors in each pair is float mounted in the associated mounting plate to enable the connector to shift during mating thereby overcoming any misalignments to achieve a satisfactory electrical connection.

9 Claims, 9 Drawing Figures

INTERCONNECTED ASSEMBLY OF AN ARRAY OF HIGH FREQUENCY COAXIAL CONNECTORS

BACKGROUND OF THE INVENTION

The subject invention relates to an interconnected assembly for an array of high frequency coaxial connectors. The subject invention includes new and improved coaxial connectors which achieve redundant or dual electrical contacts when the members are mated. The method of interconnection is simplified with one member being slidably and telescopingly received within the other thereby eliminating the need for coupling nuts, which were heretofore necessary with high frequency connectors. By eliminating the coupling nuts, the distance separating the connectors on each plate can be reduced thereby conserving space. In a preferred embodiment of the subject invention, at least one of the connector members is float mounted in the associated mounting plate to permit shifting of the member during mating thereby overcoming variations in alignment and achieving satisfactory electrical connections.

In the prior art, various coaxial connectors have been developed that utilized a butt interface link which proved necessary in high frequency applications, such as radar systems where frequencies of 18 Ghz or greater are encountered. In this type of high frequency connector, the mating end of one outer conductor is butted up against a conducting surface provided in the opposed connector. These connectors are often utilized in rack and panel devices, with one set of connectors projecting axially outwardly from the panel. In some applications, the panels were merely slid into contact with the racks, with no means being provided to prevent the separation of the connectors and the resultant breaking of the butt interface connection. More specifically, the prior art butt interface connector proved to have certain shortcomings since internal vibrations of the electrical device or alignment errors could cause the butt interface to separate resulting in a degradation of performance or a total break in the circuit.

In an effort to overcome these shortcomings, the mated pairs of connectors were provided with a coupling nut, which when tightened functioned to maintain the butt interface connection therebetween. In this arrangement, each connector must be spaced a sufficient distance from the adjacent connectors to enable a wrench or suitable driver to fit therebetween for tightening the coupling nuts. In applications where the mated connectors would be hard to reach, and coupling nuts could not be tightened, for example, after a panel is installed in a rack, flexible connector cables are provided extending between the connector members and functioning as a coupling interface therebetween. The latter arrangement, which utilized an extra connector cable, increased the cost of the assembly and altered the characteristics of the connector. Accordingly, it would be desirable to provide an interconnective assembly that could be used in tight locations but did not require flexible cables as interfaces. Further, it is apparent that with the increasing drive toward miniaturization, it would be desirable to eliminate the use of coupling nuts, such that the separation between the connectors could be reduced thereby conserving space.

Other efforts to overcome the shortcomings associated with the butt interface type of high frequency electrical connectors included providing one of the mating pair of coaxial connectors with an outer conductor of reduced diameter such that it would be slidably received within the opposed connector making electrical contact along the frictionally engaged surfaces. However, in order to provide a connector with an outer conductor having a reduced diameter, it was necessary to correspondingly reduce the diameter of the central insulator or dielectric. By reducing the diameter of the central dielectric the performance characteristics of the connectors were altered which rendered them unsuitable for high frequency applications, in the range of 18 Ghz.

In addition to the above noted shortcomings of the prior art, additional problems were encountered when the connectors were improperly aligned on the panels. More specifically, when there are a plurality of ganged connectors to be mated, the location of each connector must be accurate to within a few thousandths of an inch to enable proper mating therebetween for achieving a satisfactory electrical connection. In fact, while it may appear that the connectors are actually mated, if they are not accurately aligned, the stresses caused by the misalignment can cause damage to the connector, thereby causing a degradation of performance.

Accordingly, it is an object of the subject invention to provide a new and improved interconnected assembly of an array of coaxial connectors for high frequency applications which are of the slide on type thereby eliminating both the need for flexible cables and coupling nuts, with the elimination of the latter enabling the distance between the connectors on the associated mounting plate to be reduced thereby conserving space.

It is a further object of the subject invention to provide a new and improved high frequency coaxial connector of the slide on type which achieves a redundant or dual electrical connection wherein electrical contact is maintained even if a separation occurs between the connectors which breaks the butt interface.

It is another object of the subject invention to provide new and improved high frequency coaxial connectors which combine a butt interface connection with a frictional engagement connection and wherein the tubular insulators are of a constant diameter to maintain the high frequency characteristics of the connector.

It is still a further object of the subject invention to provide new and improved high frequency coaxial connectors wherein the mating end of the outer conductor of the female jack connector is provided with longitudinal slits to define cantilevered spring fingers which flare radially outwardly to facilitate the frictional electrical contact between the connectors.

It is still another object of the subject invention to provide a new and improved float mounting for attaching the electrical connectors to a mounting plate which enables the connector to float or shift during the mating of the connectors to insure satisfactory electrical contact.

SUMMARY OF THE INVENTION

In accordance with the above stated objects, the subject invention provides an interconnected assembly for new and improved coaxial connectors suitable for high frequency applications. The coaxial connectors are mounted in aligned pairs on generally planar mounting plates which when brought together in opposed relationship result in the mating of the pairs to establish high frequency electrical contacts therebetween. The electrical contact achieved between each pair of connectors is redundant to insure that electrical performance is maintained even if there is a break in the butt interface connection during use. More specifically, each mating pair of connectors includes first and second connector members, with the first connector member or plug, including a central conductor terminal surrounded by a tubular insulator. The tubular insulator of the plug is surrounded by an outer conductor having a minor diameter portion contiguous with the tubular insulator and a major inner diameter portion which extends axially beyond the tubular insulator towards the mating end of the plug. The diameter of the major diameter portion is greater than the diameter of the minor diameter portion such that the transition therebetween defines a circumferential step or conductive shoulder which extends transverse to the longitudinal axis of the connector and provides a surface for establishing a butt interface electrical contact with the opposed, second connector member.

The second connector member or jack, is provided with a central conductor terminal adapted to mate with the central conductor terminal of the plug. A tubular insulator surrounds the second central conductor and a second outer conductor surrounds the insulator. The mating end of the outer conductor includes a plurality of longitudinal slits which define a plurality of cantilevered spring fingers that flare radially outwardly towards the mating end. The diameter of the mating end of the jack is greater than the inner diameter of the major inner diameter portion of the plug such that when the mounting plates are brought together in opposed relationship, the connector members are mated with the spring fingers of the jack being radially compressed as the jack is telescopingly received within the major diameter portion of the plug. By this arrangement, a redundant electrical connection is achieved, which includes the frictional interfit between the spring fingers and the major diameter portion of the plug, and the butt interface connection between the mating end of the spring fingers and the circumferential conductive step of the plug. As will become apparent in the detailed description, if the connectors were to become separated, for example, due to vibrations, the electrical characteristics of the connector will not be substantially degraded because electrical contact is maintained by the interfit between the cantilevered spring fingers and the outer conductor of the plug. Further, due to the new and improved configuration of the connectors, the tubular insulators of both connector members have a constant diameter such that the connectors are suitable for use in high frequency applications.

The new and improved slide on, high frequency, coaxial connectors enable a plurality of connectors to be mounted in a closely spaced array or ganged arrangement on a mounting plate. More specifically, the distance separating each connector, along the associated mounting plate, heretofore required to be large to enable the tightening of coupling nuts, may be substantially reduced such that the new and improved slide on connectors of the subject invention may be mounted in a closely spaced array, thereby conserving valuable space. In this arrangement, only the mounting plates themselves need be clamped together to maintain satisfactory electrical performance. Further, since the mounting plates are clamped, any internal vibrations of the device will not affect the individual connections which thereby reduces the likelihood of circuit failure.

In a preferred embodiment of the subject invention, a new and improved mounting means is provided for at least one of the connectors in each mating pair. More particularly, a float mounting is disclosed which introduces a degree of flexibility to the location of the connector such that during the mating of the connectors a satisfactory electrical connection can be achieved even if the connectors are misaligned. The mounting plates of the subject invention are provided with oversized apertures and a resilient spring means, such as a wavy washer, which is interposed between the connector and the mounting plate. This arrangement permits the connectors to shift in both the axial and radial directions, as well as at an angle to the mounting plate. By enabling a connector to shift during mating, any misalignment between opposed connectors is overcome since the float mounted connector is deflected to achieve mating. Further, the biasing force of the resilient spring means maintains the connectors in electrical contact to preserve high performance characteristics.

Other objects and advantages of the subject invention will become apparent from the following detailed description when taken in conjunction with the drawings in which:

DETAILED DESCRIPTION OF THE PREFERRED EMBODIMENTS

Figure 1:
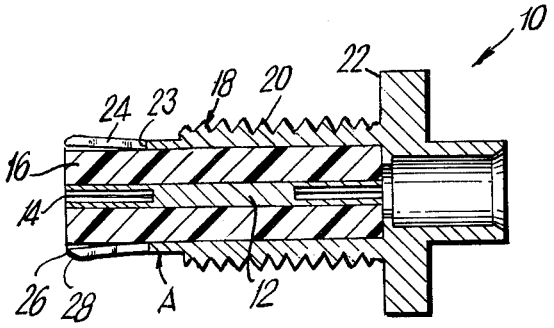
FIG. 1 is a cross sectional view of the new and improved female jack coaxial connector member of the subject invention.

Referring to FIG. 1, there is illustrated a cross sectional view of the new and improved coaxial female jack connector member of the subject invention and is designated generally by the numeral 10. The jack connector member 10 includes a central terminal 12 having a hollow receiving portion 14 disposed at the mating end thereof. Surrounding the central terminal 12 is a tubular dielectric insulator 16 which may be formed of a flurocarbon material. The outer diameter of the tubular insulator 16 is constant throughout its length. Surrounding the tubular insulator 16 is a generally cylindrical outer conductor 18 which includes a threaded portion 20 and an annular flange 22 to facilitate the attachment of the connector within a mounting plate.

In accordance with the subject invention, the mating end of the outer conductor 18 is provided with a plurality of longitudinal slits 23 which function to define cantilevered spring fingers 24 which flare radially outwardly. It is preferable that outer conductor 18 be formed of beryllium copper since the latter will retain its resilience through repeated matings. The radially outward flaring of the spring fingers 24 is exaggerated in the illustration, however it is intended that the diameter of the mating end of the outer conductor 18 increase, for example, from a minimum of about 182/1000ths of an inch (at point A) to a maximum of about 185/1000ths of an inch. The mating end of each spring finger 24 is provided with a flattened portion 26 and a chamfered or tapered portion 28. The flattened portion 26, which is disposed perpendicular to the longitudinal axis of the connector member 10, cooperates with the plug member 30 to form part of the butt interface connection, as more fully described hereinafter. The chamfered portion 28 at the edges of each spring finger 24 facilitates the insertion of the jack member 10 with the plug member 30 during mating.

Figure 2:
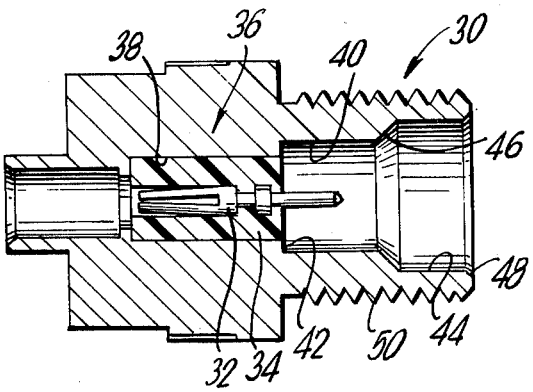
FIG. 2 is a cross sectional view of the new and improved male plug coaxial connector member of the subject invention.
Figure 3:
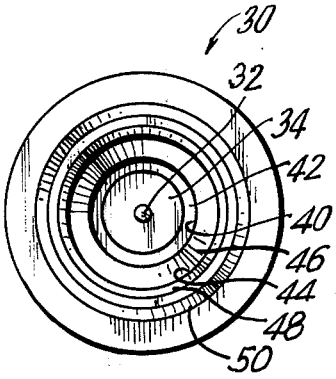
FIG. 3 is an end elevational view of the new and improved male plug coaxial connector member of the subject invention.
Figure 4:
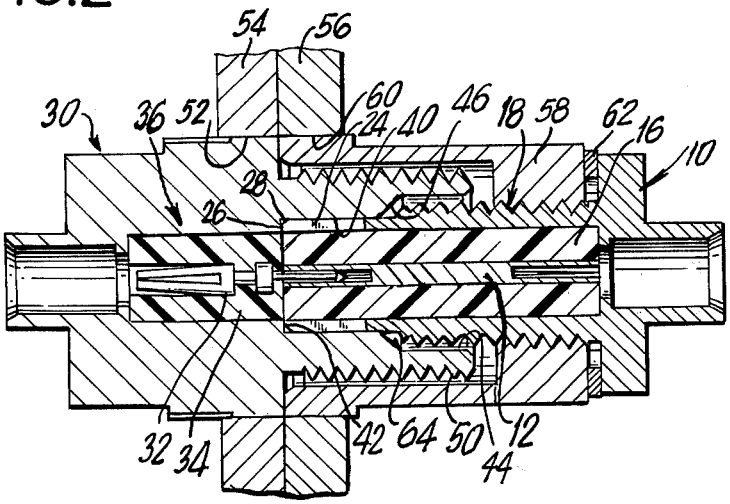
FIG. 4 is a cross sectional view of the mated connection between the new and improved coaxial connector members of the subject invention.

Referring to FIGS. 2 and 3, a coaxial male plug member 30 is illustrated and includes a solid central terminal 32. While the central terminal 32 of plug member 30 is illustrated as a solid male conductor, it is possible to provide plug member 30 with a hollow female connector if the jack member 10 were provided with a solid male central terminal. The scope of the subject invention is intended to include mating connectors having any conventional interconnecting central terminals. A tubular insulator 34 surrounds the central terminal 32 and is of constant outer diameter along its length. An outer conductor 36 surrounds the tubular insulator 34 and is provided with a minor diameter portion 38 which is contiguous with the insulator 34. The outer conductor 36 further includes an inner major diameter portion 40 which extends axially beyond the tubular insulator 34, and has a diameter greater than the minor diameter portion 38. The transition between the major and minor diameter portions 40 and 38 functions to define a circumferential step or conducting shoulder 42 which is disposed perpendicular to the longitudinal axis of the conductor and cooperates with the flattened portions 26 of the spring fingers 24 to form the butt interface connection. The major diameter portion 40 of the outer conductor 36 is adapted to receive the mating end of the jack member 10 as illustrated in FIG. 4. A second major inner diameter portion 44 is provided at the mating end of the plug member 30 with the transition between the first and second major diameter portions 40 and 44 defining a circumferential tapered or chamfered portion 46. The chamfered portion 46 acts to guide the jack member 10 within the plug member 30 during the mating therebetween. An end chamfer or tapered portion 48 is provided at the extreme mating end of the plug member 30 which also functions to guide the telescoping members into the proper orientation. The outer surface of the outer conductor 36 is preferably provided with threads 50 which may be used to facilitate the attachment of the plug member to the mounting plate.

Figure 5:
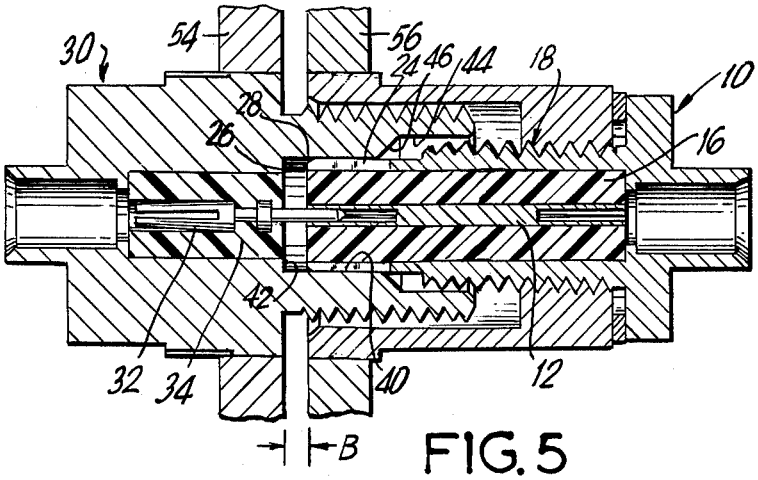
FIG. 5 is a cross sectional view of the mated connector members of the subject invention, similar to FIG. 4, wherein a slight separation between the mounting plates has occured and illustrating the continued electrical contact between the members.
Figure 8:
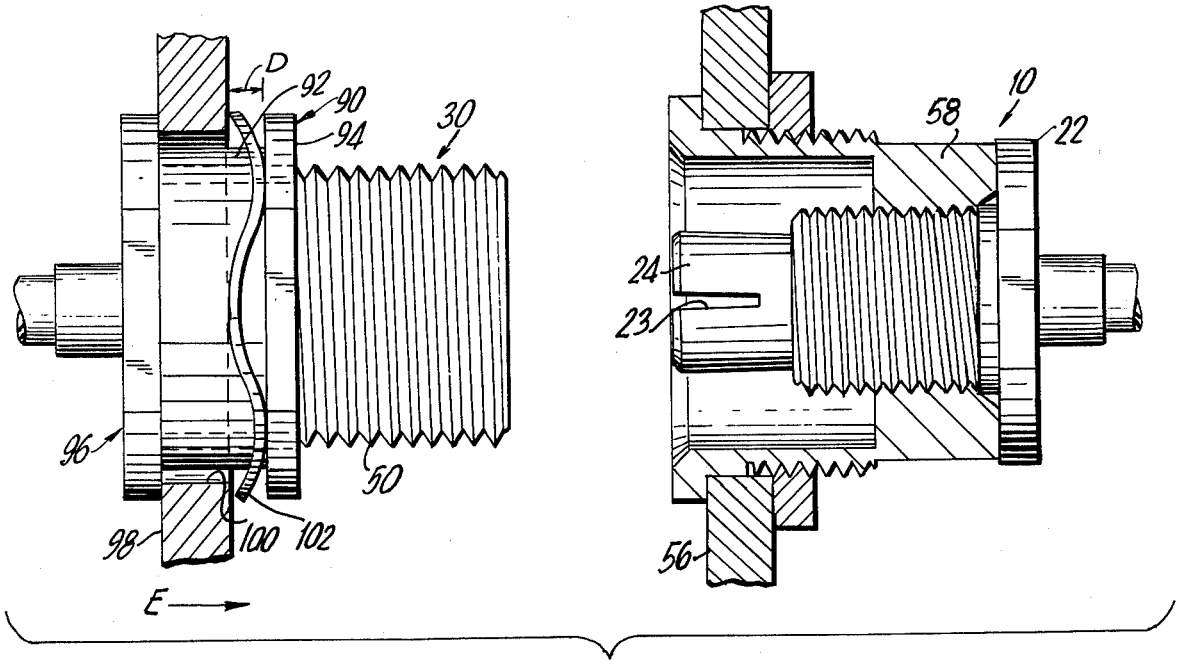
FIG. 8 is an elevational view partially in section illustrating the new and improved float mounting as used with the plug coaxial connector of the subject invention.
Figure 9:
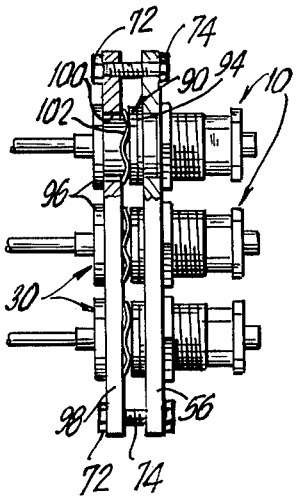
FIG. 9 is an elevational view partially in section of the interconnected assembly of the subject invention illustrating the use of a plurality of float mounted plug connectors.

In the alternative, and as illustrated in FIGS. 4 and 5, the plug member 30 may be press fit within an aperture 52 provided in a mounting plate 54. In a preferred embodiment, as illustrated in FIGS. 8 and 9, the plug member 30 is mounted within a sleeve 90 in conjunction with a resilient spring means, to achieve a float mounting, as more fully described hereinafter.

Referring to FIGS. 4 and 5, the mating connection between the plug member 30 and the jack member 10 of the subject invention is illustrated. The plug member 30 is affixed within aperture 52 of a mounting plate 54, such that its mating end projects axially outwardly towards the opposed mounting plate 56. Jack member 10 is threadably mounted in a protective sleeve 58 which is press fit within an aperture 60 provided in mounting plate 56. A washer 62 is interposed between protective sleeve 58 and the flange 22 of the jack member 10 to adjust the axial position of the plug member.

In accordance with the subject invention, during the mating procedure, the mounting plates 54 and 56 are brought into opposed relationship and the outer conductor 18 of the jack member 10 is telescopingly received within the outer conductor 36 of the plug member 30. More specifically, as the mounting plates are moved together, the mating end of jack member 10 is telescopingly received within the second major diameter portion 44 of the plug member 30, with the chamfered portion 46 functioning to align the members and radially compress spring fingers 24. As the mounting plates are moved closer, the spring fingers 24 are telescopingly received within the major diameter portion 40 creating a secure frictional interfit therebetween. When the mounting plates are in face to face contacting relationship, the flattened ends 26 of the spring fingers 24 butt against the circumferential conducting step 42 of the plug member 30. By this arrangement, a redundant electrical connection is achieved, which includes the latter butt interface connection and the frictional interfit between the spring fingers 24 and the inner surface of the major diameter portion 40. Additional electrical contact area is provided between the threaded portions 20 of the jack member 10 and the second major diameter portion 44 of the plug member 30. As illustrated in FIG. 4, the central male terminal 32 of the plug member is received within the hollow female conductor 12 of the jack member 10 to complete the coaxial connection. In applications where high humidity or moisture are encountered, an O-ring, which acts as a seal, may be provided in the space 64 adjacent chamfered portion 46 of the plug member.

As stated above, a redundant interconnection between the connector members is achieved. Further, due to the unique stepped configuration of outer conductor 36 of plug member 30, the tubular insulators 12 and 34 of both the connector members may be provided with constant and equal outer diameters. By this arrangement, a high frequency electrical contact, resulting from the frictional interfit between the spring fingers 24 and the outer conductor 36 is achieved and the degradation in performance which occured heretofore in the prior art when a dielectric having a reduced diameter was utilized is eliminated. Another significant advantage of the subject coaxial connectors is illustrated in FIG. 5 wherein the high frequency electrical connection is maintained even in situations wherein the mounting plates 54 and 56 have become slightly separated due to, for example, internal vibrations. While it is intended that the mounting plates be clamped together to prevent such an occurrence, the subject connectors may nevertheless be successfully utilized when such clamping is unfeasible. In the latter situation, if the mounting plates 54 and 56 should become separated, the butt interface connection between the flattened ends 26 of the spring fingers 24 and the circumferential conducting step 42 of the outer conductor 36 will be broken. However, a satisfactory electrical connection is still maintained between the spring fingers 24 and the inner surface of the major diameter portion 40 of the plug member 10. While the separation B between the mounting plates in FIG. 5 is exaggerated for clarity purposes, it has been found that a separation of up to a few thousandths of an inch will not appreciably reduce the electrical performance of the connectors.

Figure 6:
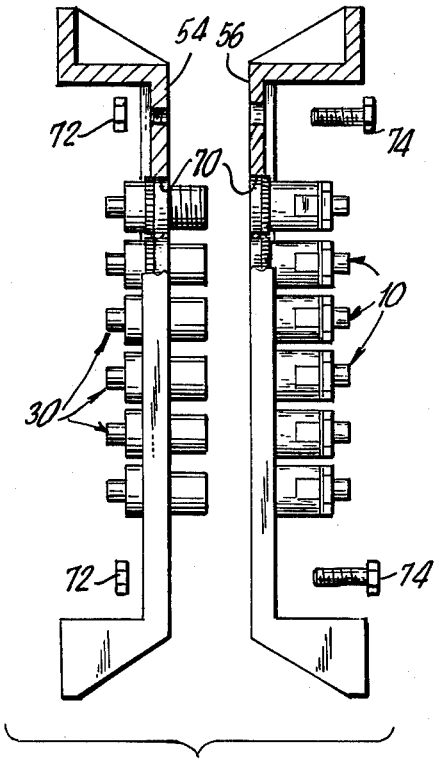
FIG. 6 is an elevational view partially in section of an array of ganged connectors of the subject invention, as shown secured to opposed mounting plates.
Figure 7:
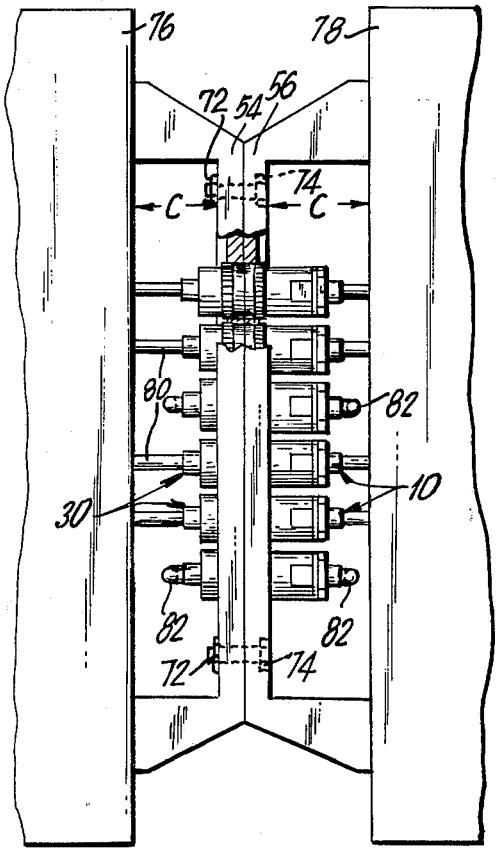
FIG. 7 is an elevational view partially in section of the new and improved interconnected assembly of the subject invention as utilized with a conventional chassis arrangement.

Referring to FIGS. 6 and 7, a preferred embodiment of the mounting assembly for use in conjunction with the subject high frequency coaxial connectors is illustrated. More particularly, as illustrated in FIG. 6, the mounting plates 54 and 56 are in the form of generally U-shaped brackets each having a plurality of closely spaced apertures 70 formed therein. The apertures in the opposed plates 54 and 56 are aligned to define opposed pairs of apertures with the connector members being securely mounted therein. In order to maintain the electrical contact between the connectors, it is preferable that a clamping means be provided to secure the opposed mounting plates 54 and 56 in face to face contacting relationship. For example, and as illustrated in FIG. 6, a pair of nut and bolt assemblies 72 and 74 may be provided such that after the opposed brackets 54 and 56 are brought together to mate the connectors, the nut and bolt assemblies 72 and 74 may be utilized to clamp the brackets thereby preventing separation of the connectors. By this arrangement, any internal vibrations will tend to affect the entire assembly rather than individual components. Another significant advantage of the subject assembly is that even when a relatively large number of mating connectors are utilized, only one or two clamping means are necessary to secure the assembly, rather than having to provide individual coupling nuts for each mating pair. Further, heretofore, when a coupling nut was utilized for each mating pair of connectors, each connector had to be separated a sufficient distance from each other to enable the nuts to be tightened by a wrench. Since this separation between the connectors is no longer necessary, the connectors may be ganged in a closely spaced array thereby conserving space. In addition, the configuration of the U-shaped brackets facilitates the tightening of nut and bolt assemblies 72 and 74 thereby speeding installation time. A further advantage of the U-shaped brackets 54 and 56 is illustrated in FIG. 7, wherein the brackets are mounted to chassis 76 and 78. The spacing C between the planar portions of the brackets 54 and 56 and the chassis 76 and 78 facilitates the wiring of the device. More specifically, some coaxial cables 80 may be wired directly into the chassis, however the spacing C permits other cables 82 to be immediately twisted and routed to other components, thereby reducing cable lengths.

Referring now to FIGS. 8 and 9, there is illustrated a preferred embodiment of the subject invention wherein a connector member is float mounted in the mounting plate for overcoming alignment errors thereby facilitating the mating of the connectors. The float mounting, which may be utilized with either or both of the plug 30 and jack 10 connector members, includes providing an oversized mounting aperture in conjunction with a spring means to enable the connector member to shift or deflect during mating. More specifically, and as illustrated in FIG. 8, the float mounting includes an outer sleeve member 90 having a generally cylindrical portion 92 and an annular flange 94. The sleeve 90 further includes internal threading (not shown) to receive the threaded portion 50 of the plug 30. In this embodiment of the subject invention, the plug 30 is provided with a rear flange 96 to provide a bracing support against mounting plate 98. Mounting plate 98 is provided with an aperture 100 having a diameter greater than the outer diameter of the cylindrical portion 92 of sleeve 90. Preferably, if a conventional sleeve is utilized, having an outer diameter of approximately one half of an inch, the diameter of aperture 100, should be approximately two hundredths of an inch greater. The oversized aperture 100 enables the sleeve 90 and plug member 30 to shift radially, or perpendicular to its longitudinal axis. To allow for movement along the longitudinal axis of the connector, a resilient spring means 102 is provided which is interposed between the flange 94 of the sleeve 90 and the mounting plate 98. The spring means 102 can be a wavy washer, a coiled spring or any other suitable resilient member. The spring means 102 allows the plug member 30 to shift axially, within aperture 100. As illustrated in FIG. 8, spring means 102 is a wavy washer having a thickness of approximately seven thousandths of an inch, and an effective width D, of between thirty and sixty thousandths of an inch.

To assemble the float mounting of the subject invention, the plug member 30 is inserted into the aperture 100 in a direction of arrow E until the flange 96 butts up against the rear of mounting plate 98. Thereafter, the sleeve 92 with the spring means 102 is threadably tightened onto the mating end of plug member 30 in the direction opposite to arrow E. The combination of the oversized aperture 100 with spring means 102 enables the plug member 30 to float or shift, not only in the longitudinal and radial directions, but in addition, may be angularly displaced, whereby the plane of the mating end may be shifted out of parallel with the plane of the mounting plate 98.

The incorporation of a float mounting with the interconnected assembly of the subject invention greatly facilitates the mating of the connectors by overcoming alignment errors. Frequently, repeated use or mishandling of the connector assemblies will create alignment problems. Further, even in the initial manufacture of the mounting assemblies, production errors frequently occur resulting in misaligned connectors. The float mounting of the subject invention is intended to overcome these alignment errors. More specifically, in use, as the mounting plates are brought together in opposed relationship, if a pair of connector members are not properly aligned, the pressure of mating which is typically between two and four inch pounds, will cause the float mounted connector member to shift, enabling the opposed member to slide easily into place. Once the connectors are seated, as illustrated in FIG. 9, the resilient spring members 102 functions to maintain the members in close contact, establishing a satisfactory electrical connection. To achieve the latter result, the spring means 102 must have sufficient resiliency to overcome the mating forces such that the float mounted connector member will be forced into electrical contact with the opposed connector.

In summary, there is provided a new and improved interconnected assembly for an array of high frequency, coaxial connectors which includes a pair of opposed, planar mounting plates each having an array of aligned closely spaced apertures. A plurality of coaxial, electrical connectors are mounted in the apertures to define opposed mating pairs of plugs and jack members. The plug members are provided with a central conductor surrounded by a tubular insulator and a generally cylindrical outer conductor having a minor inner diameter portion which is contiguous with the tubular insulator. The plug member further includes a major inner diameter portion which extends axially beyond the tubular insulator and has a diameter greater than the minor diameter portion. The transition between the major and minor diameter portion functions to define a circumferential conductive step extending transverse to the longitudinal axis of the plug member. The jack member of the subject invention includes a central conductor adapted to mate with the central conductor of the plug member. A tubular insulator surrounds the central conductor and a second outer conductor surrounds the tubular insulator. The mating end of the second outer conductor includes a plurality of longitudinal slits that define cantilevered spring fingers which flare radially outwardly. The diameter of the mating end of the second outer conductor is greater than the inner diameter of the major inner diameter portion of the plug member. By this arrangement, when the mounting plates are brought together in opposed relationship, the central connectors are mated, while the spring fingers of the jack members are radially compressed as it is telescopingly received within the major inner diameter portion of the plug member. The configuration of the new and improved connector members functions to establish a redundant or dual electrical contact, which includes the butt interface connection between the ends of the spring fingers and the circumferential conductive step of the plug member, as well as the frictional interfit between the spring fingers and the inner surface of the major inner diameter portion. The redundant connection functions to maintain the high frequency electrical characteristics of the connectors even if they become separated during use. In a preferred embodiment of the subject invention, one or both of the connectors are attached to the plates via a float mounting which includes a spring means to enable the connector members to shift during mating. By this arrangement, misalignments between any pair of connectors will not prevent a satisfactory mating.

Although the subject invention has been described by reference to preferred embodiments, it is apparent that other modifications could be devised by those skilled in the art that would fall within the scope and spirit of the present invention as defined by the appended claims.

I claim:

1. An interconnected assembly of an array of high frequency coaxial connectors capable of operation at frequencies on the order of 18 Ghz comprising:

a pair of opposed planar mounting plates, each plate having an array of closely spaced apertures with the respective apertures in said plates being aligned to define opposed pairs; and a plurality of coaxial electrical connectors respectively mounted in said apertures to define opposed mating pairs, each mating pair of connectors including first and second connector members;

each said first connector member having a first central conductor surrounded by a tubular insulator and a first generally cylindrical outer conductor, said first outer conductor having a minor inner diameter portion contiguous with said tubular insulator, said first outer conductor further including a major inner diameter portion extending axially beyond said tubular insulator towards the mating end thereof, with the diameter of said major inner diameter portion being greater than the diameter of said minor inner diameter portion such that the transition between said portions defines a circumferential step extending transverse to the longitudinal axis of said first connector member;

each said second connector member having a second central conductor surrounded by a tubular insulator and a second generally cylindrical outer conductor, with the mating end of said second outer conductor including a plurality of longitudinal slits and with said second outer conductor being flared radially outwardly towards the mating end thereof to define a plurality of cantilevered spring fingers, with the diameter of the mating end of said second outer conductor being greater than the inner diameter of said major inner diameter portion of said first outer conductor when said spring fingers are flared radially outwardly, said spring fingers being radially compressible against said tubular insulator to define a cylinder having a constant diameter along substantially its entire length equal to the inner diameter of said major inner diameter portion of said first outer conductor, the mating end of each said cantilevered spring finger of said second connector members being chamfered to facilitate its radial compression during mating, and the mating end of each said cantilevered spring finger further including a flattened portion disposed transverse to the longitudinal axis of said second connector member, said opposed mounting plates being disposed such that said connector members are mated to interconnect the respective first and second central conductors and with said spring fingers being radially compressed within the major inner diameter portion of said first outer conductor such that said radially compressed fingers form a mechanical connection between said first and second connector members and frictionally hold said first and second connector members of said array in a high frequency electrical connection, and with the flattened portion of the mating end of said spring fingers abutting against said circumferential step of said first connector thereby establishing a redundant interconnection between said first and second outer conductors.

2. An interconnected assembly of an array of high frequency coaxial connectors as recited in claim 1 wherein the opposed ends of said planar mounting plates include transverse portions such that said mounting plates define a generally U-shaped configuration, said U-shaped configuration for facilitating the wiring of said connectors.

3. An interconnected assembly of an array of high frequency coaxial connectors as recited in claim 1 wherein said opposed planar mounting plates are securely clamped to maintain electrical contact between said connector members.

4. An interconnected assembly of an array of high frequency coaxial connectors as recited in claim 1 wherein one connector member of each pair is provided with a spring mounting means to permit said one connector to shift during the mating of said connectors, said spring mounting means including a resilient member interposed between said one connector and said mounting plate.

5. An interconnected assembly of an array of high frequency coaxial connectors as recited in claim 4 wherein the diameter of said aperture associated with said spring mounted connector member is greater than the outer diameter of said one connector member thereby enabling said one connector member to shift both axially and radially relative to the longitudinal axis of said one connector member, as well as angularly thereto.

6. An interconnected assembly of an array of high frequency coaxial connectors as recited in claim 4 wherein said spring mounting means further includes a sleeve, said sleeve being interposed between the associated aperture in said mounting plate and said one connector member, with said one connector member being affixed within said sleeve, said sleeve including an annular flange, and with said resilient member being disposed around said sleeve and interposed between said annular flange and said mounting plate.

7. An interconnected assembly of an array of high frequency coaxial connectors as recited in claim 6 wherein said sleeve is received in said aperture, and wherein the outer diameter of said sleeve which is received in said aperture of said mounting plate is less than the diameter of said aperture to permit said one connector member to shift in a direction perpendicular to the longitudinal axis of said connector member.

8. An interconnected assembly of an array of high frequency coaxial connectors as recited in claim 1 wherein each said first connector member is further provided with a second major inner diameter portion extending axially beyond said major inner diameter portion, with the diameter of said second major inner diameter portion being greater than said major inner diameter portion, and with the transition between said major diameter portions defining a chamfered portion disposed transverse to the longitudinal axis of said first connector member, said chamfered portion for guiding said spring fingers into said major inner diameter portion during mating.

9. An interconnected assembly of an array of high frequency coaxial connectors as recited in claim 1 wherein said tubular insulators of said connector members have a constant outer diameter throughout their length.

* * * * *